US005100295A

United States Patent [19]

Madden

[11] Patent Number: 5,100,295

[45] Date of Patent: Mar. 31, 1992

[54] IMPELLER PUMPS

[75] Inventor: Michael Madden, Warrington, England

[73] Assignee: NNC Limited, England

[21] Appl. No.: 404,102

[22] Filed: Sep. 7, 1989

[30] Foreign Application Priority Data

Sep. 16, 1988 [GB] United Kingdom ..... 8821729

[51] Int. Cl.[5] ..... B63H 1/00

[52] U.S. Cl. ..... 416/175; 415/143; 416/183

[58] Field of Search ..... 416/175, 183; 415/143, 415/97, 215.1

[56] References Cited

U.S. PATENT DOCUMENTS

| | | | |
|---|---|---|---|
| 2,761,393 | 9/1956 | DiStefano et al. | 415/215 |
| 3,153,119 | 12/1964 | Huppert et al. | 415/98 |
| 3,644,056 | 2/1972 | Wiselius | 415/215 |
| 3,953,150 | 4/1976 | Onal | 416/175 X |
| 4,443,152 | 4/1984 | Wong et al. | 415/143 |
| 4,530,639 | 7/1985 | Mowill | 415/98 |
| 4,826,398 | 5/1989 | Gullichsen | 415/143 |

FOREIGN PATENT DOCUMENTS

| | | | |
|---|---|---|---|
| 120608 | 12/1945 | Australia | 416/175 |
| 0205001 | 12/1986 | European Pat. Off. . | |
| 584056 | 1/1947 | United Kingdom . | |
| 1218023 | 1/1971 | United Kingdom . | |
| 1419548 | 12/1975 | United Kingdom . | |
| WO8501992 | 5/1985 | World Int. Prop. O. . | |

*Primary Examiner*—William E. Wayner

*Attorney, Agent, or Firm*—Kirschstein, Ottinger, Israel & Schiffmiller

[57] ABSTRACT

A mixed-flow impeller pump, which may be used, for example, as a primary pump for circulating sodium as the primary coolant in a fast nuclear reactor, comprises an impeller with evenly-spaced blades. Some of the blades, which are symmetrically disposed around the axis of rotation of the impeller, extend beyond the ends of the other blades towards the suction side of the pump to form an inducer. The channels defined between the extensions of the extended blades follow helical paths parallel to the axis of rotation. The leading edges of the unextended blades are interposed between the extended blades in the region of divergence of flow from the axis of rotation. The provision of the inducer reduces the risk of cavitation in the pump, which could cause rapid wear of the impeller.

7 Claims, 1 Drawing Sheet

IMPELLER PUMPS

BACKGROUND OF THE INVENTION

1. Field of the Invention

This invention relates to impeller pumps, and particularly to impeller pumps for use as the primary pumps by which a liquid metal, such as sodium, is circulated as the primary coolant in a fast nuclear reactor.

2. Description of Related Art

In such a reactor the liquid metal circulates from the pumps, of which there are several, through the reactor core for the cooling thereof, and then through heat exchangers for transfer of heat to a secondary coolant before return to the suction side of the pumps.

In the interest of economy there is an incentive to increase the rotational speed of the primary pumps, in order to reduce the overall pump size and to enable fewer individual pumps to achieve a given duty. However, a limit is imposed on the increase in rotational speed by the onset of cavitation which can give rise to rapid wear of the impeller, especially when the nature of the circulation is such that vapour bubbles implode at the impeller surfaces, leading to erosion and pitting.

SUMMARY OF THE INVENTION

It is therefore an object of the invention to improve the design of impeller pumps so that an increase in rotational speed is possible without the occurrence of cavitation.

In the type of impeller pump known as a mixed-flow pump, the flow through the impeller not only tends towards being radial, as in a centrifugal pump, but initially tends more towards being axial such that the general direction of flow from entry into and discharge from the impeller is one of progressively increasing divergence from the axis of rotation of the impeller.

According to the invention there is provided a mixed-flow impeller pump having an impeller with evenly-spaced blades, in which, in order to avoid or reduce the risk of cavitational erosion of the impeller, at least two of the blades in symmetrical disposition around the axis of rotation of the impeller extend forwardly beyond the remainder of the blades towards the suction side of the pump to form an inducer wherein channels defined between the extended blades follow helical paths parallel to the rotational axis, the leading edges of the unextended blades being interposed between the extended blades in the region of divergence of flow from the axis of rotation.

The smaller the number of blades by which the inducer is formed the less the degree of restriction of entry area caused by blade volume compared with all the blades being present at entry. This in itself helps, by easing entry flow velocity, to depress the cavitation threshold but, with the larger channel widths, the eventual onset of cavitation will occur with a lower probability of bubble implosion on the surfaces of the blades. Furthermore, where such implosion on blade surfaces does take place, it will occur in the inducer, which is less important than the rest of the impeller from the point of view of the length of working life of the pump, a factor which is paramount for its duty as the primary pump in a fast nuclear reactor.

The blade extensions are to be continuations without interruptions, of the extended blades and rather than employ a separately manufacturered inducer to bolt or weld on to the front of the rest of the impeller to form these continuations, it may be found better to make them integral. Even if hand dressing of the blades is necessary, especially at the entry end where control of the geometry to fine limits is generally regarded as essential, the decrease in the number of blades to form the inducer in itself reduces the extent of hand dressing, which may be further reduced by reduced sensitivity to profile tolerances resulting from enlargement of entry area with fewer blades.

BRIEF DESCRIPTION OF THE DRAWINGS

An embodiment of the invention will now be described, by way of example, with reference to the accompanying drawing, in which.

DETAILED DESCRIPTION OF THE PREFERRED EMBODIMENT

Figure 1:
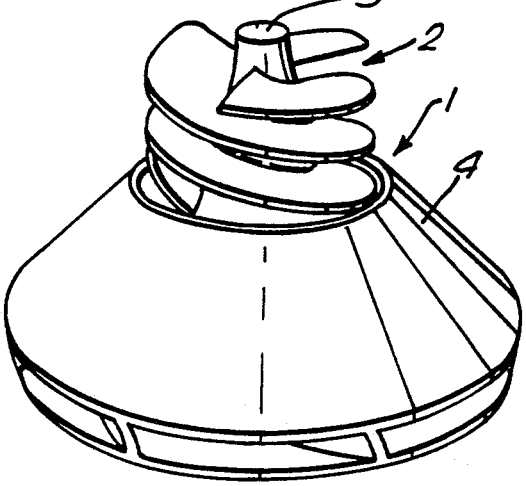
FIG. 1 is a pictorial view of an impeller of a pump in accordance with the invention.
Figure 2:
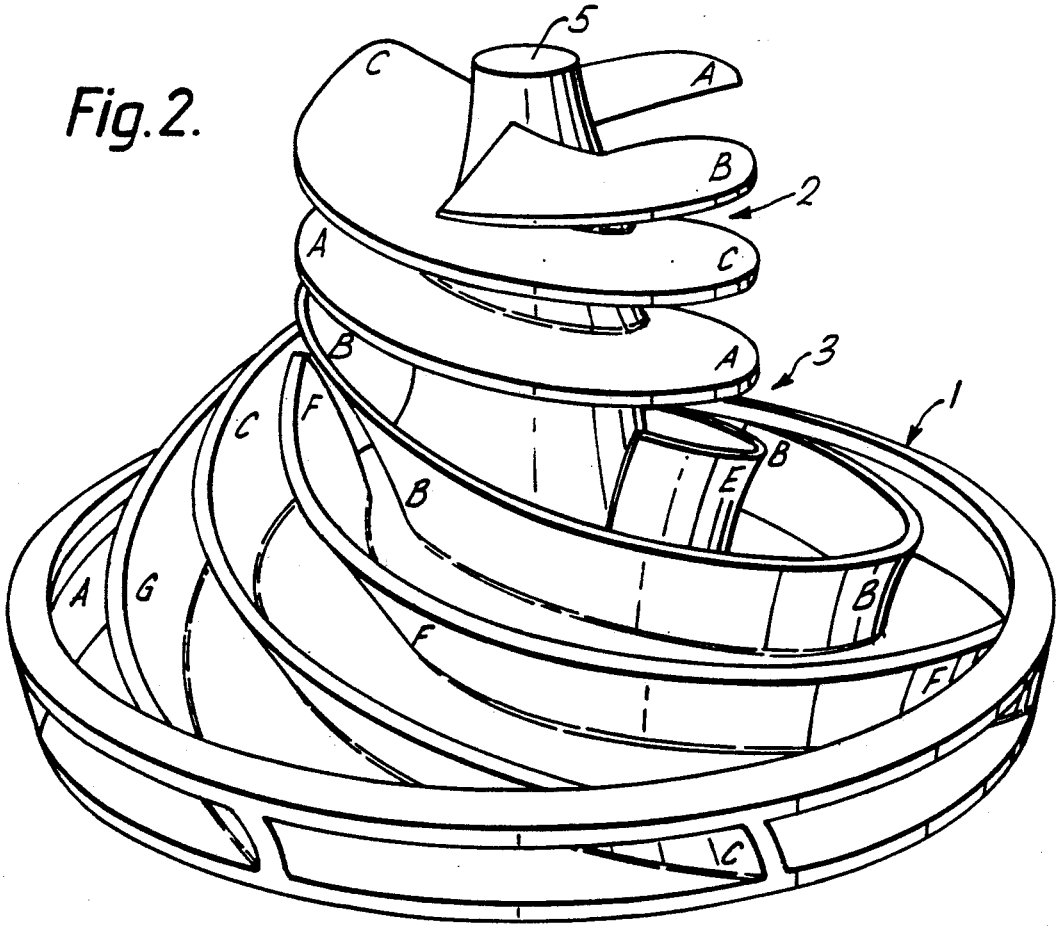
FIG. 2 is an enlarged view of the impeller of FIG. 1 with its front shroud removed to reveal the configuration of all of its blades.

FIGS. 1 and 2 of the drawing show an example of an impeller 1 having six blades A, B, C, E, F and G. Of these six blades, a first group of alternate blades A, B, and C (which are therefore displaced angularly by 120° relative to one another) extend continuously and forwardly to form an axial inducer 2 with a three-start entry (at the top end as viewed in the drawing). The unextended blades E, F and G form a second group which terminate to form leading edges in a region 3 where the blade configuration causes divergence of flow from the axial direction. At this region a radial flaring takes places to accommodate the interposition of the unextended blades E, F and G. As seen in FIG. 1, a front shroud 4 covers the full length of the unextended blades, with only a small overlap into the length of the inducer 2, thereby leaving the inducer unshrouded over the greater portion of its length.

It will be noted that from the upper end of the impeller as viewed in the drawing, the blade extensions forming the inducer 2 turn through approximately 300° before reaching the leading edges of the unextended blades. A full turn of 360°, or even more, may be suitable in some circumstances, especially if the number of extended blades were to be only two. In general terms it is thought that at least a three-quarter turn, i.e. at least 270°, sets a lower limit for the purposes envisaged.

As just mentioned, only two blades may be extended with a six blade impeller. With an eight blade design it could be two or four, and in a ten blade design two or five. For a nine blade design only three would be possible. Where only enough blades are extended, with a design having at least six blades, for the leading edges of the unextended blades to be interposed in numbers of at least two, a staggering of the positions of the several leading edges interposed between adjacent blades will be desirable.

In order, for a given pump volume flow rate, to maximise inlet flow passage areas available for flow, and thereby minimise inlet flow velocities in order to avoid the onset of cavitation on the leading edges of the inducer blades, it is desirable to keep the diameter of the pump impeller drive shaft 5 at the inlet as small as possible compatible with providing adequate strength. For this reason, the end of the drive shaft 5 is preferably tapered as shown in the figures.

Figure 3:
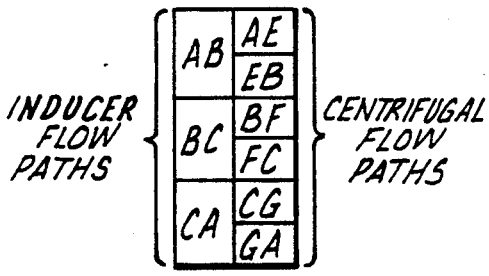
FIG. 3 is a table indicating the flow paths through the impeller.

FIG. 3 of the drawing is a table indicating the flow paths for the inducer 2 and the centrifugal flow paths.

I claim:

1. A mixed-flow impeller pump having an impeller which is rotatable about an axis of rotation and which has entry and discharge ends, the impeller comprising first and second groups of blades, the blades of said first group being interposed symmetrically between the blades of said second group, said first group comprising at least two blades but not more blades than said second group; said blades of said first and second groups being shaped to produce a flow which from a region of divergence to said discharge end of the impeller diverges progressively from said axis of rotation, the blades of said second group having leading edges substantially at said region of divergence and the blades of said first group having extensions such that the blades of said first group extend towards said entry end further than the blades of said second group to form adjacent said entry end an axial inducer, said blade extensions being of substantially constant outer diameter and defining therebetween channels which follow helical paths around said axis of rotation.

2. A pump as claimed in claim 1, in which alternate blades are extended to form the inducer.

3. A pump as claimed in claim 1, in which only enough blades are extended to form the inducer from a total number of at least six blades for the leading edges of the blades of said second group to be interposed between the extended blades in numbers of at least two.

4. A pump as claimed in claim 3, in which the leading edges between adjacent extended blades are in staggered positions.

5. A pump as claimed in claim 1, in which the blades of said first group forming the inducer have extensions that are integral parts of the blades of said first group.

6. A pump as claimed in claim 1, in which the blades of said first group forming the inducer have extensions that are unshrouded over at least a portion of the length of the inducer.

7. A mixed-flow impeller pump having an impeller which is rotatable about an axis of rotation and which has entry and discharge ends, the impeller comprising first and second groups of blades, the blades of said first group being interposed symmetrically between the blades of said second group, said first group comprising at least two blades but not more blades than said second group; said blades of said first and second groups being shaped to produce a flow which from a region of divergence to said discharge end of the impeller diverges progressively from said axis of rotation, wherein the blades of said second group have leading edges that are interposed between the blades of said first group at said region of divergence, and the blades of said first group are extended toward said entry end further than the blades of said second group to form adjacent said entry end an inducer wherein channels defined between the blades of the first group follow helical paths parallel to said axis of rotation and extending around said axis of rotation by an angle of at least 270° before reaching the leading edges of the blades of said second group.

* * * * *